US007744667B2

(12) United States Patent
Oh et al.

(10) Patent No.: US 7,744,667 B2
(45) Date of Patent: Jun. 29, 2010

(54) CYCLONE SEPARATING APPARATUS FOR A VACUUM CLEANER

(75) Inventors: Jang-keun Oh, Gwangju (KR); Min-ha Kim, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 474 days.

(21) Appl. No.: 11/892,971

(22) Filed: Aug. 29, 2007

(65) Prior Publication Data

US 2008/0184681 A1 Aug. 7, 2008

(30) Foreign Application Priority Data

Feb. 5, 2007 (KR) ..... 10-2007-0011662

(51) Int. Cl.
*B01D 45/12* (2006.01)

(52) U.S. Cl. ..... 55/343; 55/349; 55/457; 55/459.1; 55/429; 55/DIG. 3

(58) Field of Classification Search ..... 55/343, 55/346, 349, 429, 457, 459.1, DIG. 3
See application file for complete search history.

(56) References Cited

U.S. PATENT DOCUMENTS

| | | | |
|---|---|---|---|
| 1,207,034 | A | 12/1916 | Harsant |
| 1,416,885 | A | 5/1922 | Schreiner |
| 1,416,995 | A | 5/1922 | Stroud |
| 2,511,387 | A | 6/1950 | Watson et al. |
| 2,539,195 | A | 1/1951 | Lang |
| 2,539,257 | A | 1/1951 | Limberg |
| 2,553,175 | A | 5/1951 | Davenport et al. |
| 3,046,718 | A | 7/1962 | Ide et al. |
| 3,078,650 | A | 2/1963 | Anderson |
| 3,425,192 | A | 2/1969 | Davis |
| 3,769,781 | A | 11/1973 | Klein et al. |
| 3,898,068 | A | 8/1975 | McNeil |
| 4,373,228 | A | 2/1983 | Dyson |
| 4,826,515 | A | 5/1989 | Dyson |
| 4,853,008 | A | 8/1989 | Dyson et al. |
| 5,078,761 | A | 1/1992 | Dyson |
| 5,145,499 | A | 9/1992 | Dyson et al. |
| 5,160,356 | A | 11/1992 | Dyson |
| 5,163,786 | A | 11/1992 | Christianson |
| 5,254,147 | A | 10/1993 | Finke |
| 5,307,538 | A | 5/1994 | Rench et al. |
| 6,171,356 | B1 | 1/2001 | Twerdun et al. |
| 6,238,451 | B1 | 5/2001 | Conrad et al. |

(Continued)

FOREIGN PATENT DOCUMENTS

| | | |
|---|---|---|
| CN | 87205753 | 10/1987 |

(Continued)

*Primary Examiner*—Robert A Hopkins
(74) *Attorney, Agent, or Firm*—Blank Rome LLP

(57) ABSTRACT

A cyclone separating apparatus for a vacuum cleaner includes a first cyclone having an inclined part and adapted for separating dust and air; a first dust chamber adapted to be disposed substantially around the first cyclone and to be in fluid communication with the first cyclone; at least one second cyclone for separating dust and air adapted to be disposed above the first cyclone and to be in fluid communication with the first cyclone; and a second dust chamber adapted to be in disposed within the first cyclone and to be in fluid communication with the second cyclone.

20 Claims, 9 Drawing Sheets

U.S. PATENT DOCUMENTS

| | | | | |
|---|---|---|---|---|
| 6,264,712 | B1 | 7/2001 | Decker | |
| 6,269,518 | B1 | 8/2001 | Yung | |
| 6,334,234 | B1 | 1/2002 | Conrad et al. | |
| 6,368,373 | B1 | 4/2002 | Mueller | |
| 6,428,589 | B1 | 8/2002 | Bair et al. | |
| 6,431,404 | B1 | 8/2002 | Long, Jr. | |
| 6,436,160 | B1 | 8/2002 | Stephens et al. | |
| 6,485,536 | B1 | 11/2002 | Masters | |
| 6,582,489 | B2 | 6/2003 | Conrad | |
| 6,607,572 | B2 | 8/2003 | Gammack et al. | |
| 6,625,845 | B2 | 9/2003 | Hayashi et al. | |
| 6,740,144 | B2 | 5/2004 | Conrad et al. | |
| 6,746,500 | B1 | 6/2004 | Park et al. | |
| 6,766,558 | B1 | 7/2004 | Matsumoto et al. | |
| 6,829,804 | B2 | 12/2004 | Sepke | |
| 7,097,680 | B2 | 8/2006 | Oh | |
| 7,140,068 | B1 | 11/2006 | Vander Baan et al. | |
| 7,169,201 | B2 | 1/2007 | Oh et al. | |
| 7,410,517 | B2 * | 8/2008 | Han et al. | 55/337 |
| 2001/0005983 | A1 | 7/2001 | Berfield et al. | |
| 2001/0005986 | A1 | 7/2001 | Matsubara et al. | |
| 2001/0025395 | A1 | 10/2001 | Matsumoto et al. | |
| 2001/0054213 | A1 | 12/2001 | Oh et al. | |
| 2002/0011053 | A1 | 1/2002 | Oh | |
| 2002/0020154 | A1 | 2/2002 | Yang | |
| 2002/0043055 | A1 | 4/2002 | Conrad | |
| 2002/0066366 | A1 | 6/2002 | Conrad et al. | |
| 2003/0067765 | A1 | 4/2003 | Li | |
| 2004/0010885 | A1 | 1/2004 | Hitzelberger et al. | |
| 2004/0025285 | A1 | 2/2004 | McCormick et al. | |
| 2004/0074041 | A1 | 4/2004 | Overvaag | |
| 2004/0098958 | A1 | 5/2004 | Roth et al. | |
| 2004/0103785 | A1 | 6/2004 | North | |
| 2005/0050678 | A1 | 3/2005 | Oh et al. | |
| 2005/0252180 | A1 | 11/2005 | Oh et al. | |
| 2006/0123590 | A1 | 6/2006 | Fester et al. | |
| 2006/0230726 | A1 | 10/2006 | Oh et al. | |
| 2007/0144116 | A1 * | 6/2007 | Hong et al. | 55/345 |

FOREIGN PATENT DOCUMENTS

| | | | |
|---|---|---|---|
| CN | 2087999 | | 11/1991 |
| CN | 1067295 | | 12/1992 |
| CN | 22550815 | Y | 2/1997 |
| CN | 1296801 | A | 5/2000 |
| CN | 1361673 | | 7/2000 |
| CN | 2518598 | | 10/2002 |
| CN | 1389175 | | 1/2003 |
| CN | 2530580 | | 1/2003 |
| CN | 1422187 | | 6/2003 |
| CN | 1426745 | | 7/2003 |
| CN | 1434688 | | 8/2003 |
| DE | 1282872 | | 11/1968 |
| DE | 2811536 | | 11/1978 |
| DE | 1336829 | | 11/1979 |
| DE | 29908567 | U1 | 1/2000 |
| DE | 20102723 | | 6/2001 |
| DE | 10132690 | | 7/2002 |
| DE | 20306405 | | 10/2003 |
| DE | 10110581 | C2 | 11/2003 |
| DE | 102004028677 | | 3/2005 |
| DE | 10 2004028678 | | 4/2005 |
| DE | 102004028675 | | 4/2005 |
| DE | 102004028676 | | 4/2005 |
| DE | 102004030600 | | 9/2005 |
| EP | 0095354 | | 11/1983 |
| EP | 0 728 435 | | 8/1996 |
| EP | 0923992 | A2 | 6/1999 |
| EP | 1199023 | A1 | 4/2002 |
| EP | 1362543 | | 11/2003 |
| EP | 1 676 516 | | 7/2006 |
| EP | 1 707 273 | | 10/2006 |
| EP | 1 774 889 | | 4/2007 |
| EP | 1 776 910 | | 4/2007 |
| ES | 2105467 | | 10/1997 |
| ES | 2196837 | | 12/2003 |
| FR | 2619498 | | 2/1989 |
| FR | 2859370 | | 3/2005 |
| GB | 835884 | | 5/1960 |
| GB | 1107045 | | 3/1968 |
| GB | 1207034 | | 9/1970 |
| GB | 2317122 | | 3/1998 |
| GB | 2326360 | | 12/1998 |
| GB | 2 360 719 | | 10/2001 |
| GB | 2360719 | | 10/2001 |
| GB | 2 362 341 | | 11/2001 |
| GB | 2374305 | | 10/2002 |
| GB | 2375980 | | 12/2002 |
| GB | 2376176 | | 12/2002 |
| GB | 2377656 | | 1/2003 |
| GB | 2381484 | | 5/2003 |
| GB | 2406065 | | 3/2005 |
| JP | 50101012 | | 8/1975 |
| JP | 5214775 | | 2/1977 |
| JP | SHO 53-141859 | | 11/1978 |
| JP | 09-234174 | | 9/1997 |
| JP | 09234174 | | 9/1997 |
| JP | 2002051951 | | 2/2002 |
| JP | 2002143052 | | 5/2002 |
| JP | 2002172077 | | 6/2002 |
| JP | 2002326041 | | 11/2002 |
| JP | 2003024826 | | 1/2003 |
| JP | 2003116752 | | 4/2003 |
| JP | 2004357767 | A | 12/2004 |
| KR | 1019930000527 | B1 | 1/1993 |
| KR | 19930021001 | | 10/1993 |
| KR | 1020030032497 | A | 4/2003 |
| KR | 1020040017195 | A | 2/2004 |
| KR | 102004009998 | | 12/2004 |
| KR | 10-0560967 | | 3/2006 |
| KR | 100 645 951 | | 11/2006 |
| RU | 2137530 | | 9/1999 |
| RU | 2174452 | | 10/2001 |
| RU | 2206029 | | 6/2003 |
| WO | WO-99/42198 | | 8/1999 |
| WO | WO-0044272 | | 8/2000 |
| WO | WO-00/64321 | | 11/2000 |
| WO | WO-00/74547 | | 12/2000 |
| WO | WO-00/74548 | | 12/2000 |
| WO | WO-01/60524 | A1 | 8/2001 |
| WO | WO-0174493 | | 10/2001 |
| WO | WO-0195780 | | 12/2001 |
| WO | WO-02067750 | | 9/2002 |
| WO | WO-02067756 | | 9/2002 |
| WO | WO 0330702 | | 4/2003 |

* cited by examiner

CYCLONE SEPARATING APPARATUS FOR A VACUUM CLEANER

CROSS-REFERENCES TO RELATED APPLICATIONS

This application claims the benefit of priority under 35 U.S.C. §119(a) from Korean Patent Application No. 2007-11662 filed Feb. 5, 2007 in the Korean Intellectual Property Office, the disclosure of which is incorporated herein by reference in its entirety.

This application may be related to the copending U.S. patent application Ser. No. 10/840,248, filed May 7, 2004 entitled "Cyclone Separating Apparatus and a Vacuum Cleaner Having the Same" by Jang-Keun Oh et al., the entire disclosure of which is incorporated herein by reference.

This application may be related to the copending U.S. patent application Ser. No. 10/840,230, filed May 7, 2004 entitled "Cyclone Separating Apparatus and a Vacuum Cleaner Having the Same" by Jang-Keun Oh et al., the entire disclosure of which is incorporated herein by reference.

This application may be related to the copending U.S. patent application Ser. No. 10/840,231, filed May 7, 2004 entitled "Cyclone Dust Separating Apparatus and Vacuum Cleaner Having the Same" by Jang-Keun Oh et al., the entire disclosure of which is incorporated herein by reference.

This application may be related to the copending U.S. patent application Ser. No. 10/851,114, filed May 24, 2004 entitled "Cyclone Dust Collecting Device for Vacuum Cleaner" by Jang-Keun Oh et al., the entire disclosure of which is incorporated herein by reference.

This application may be related to the copending U.S. patent application Ser. No. 10/874,257, filed Jun. 24, 2004 entitled "Cyclone Dust Collecting Apparatus for a Vacuum Cleaner" by Jang-Keun Oh et al., the entire disclosure of which is incorporated herein by reference.

This application may be related to the copending U.S. patent application Ser. No. 11/137,506, filed May 26, 2005 entitled "Vacuum Cleaner Dust Collecting Apparatus" by Jung-Gyun Han et al., the entire disclosure of which is incorporated herein by reference.

This application may be related to the copending U.S. patent application Ser. No. 11/206,878, filed Aug. 19, 2005 entitled "Dust Collecting Apparatus of a Vacuum Cleaner" by Ji-Won Seo et al., the entire disclosure of which is incorporated herein by reference.

This application may be related to the copending U.S. patent application Ser. No. 11/203,990, filed Aug. 16, 2005 entitled "Dust-Collecting Apparatus and Method for a Vacuum Cleaner" by Ji-Won Seo et al., the entire disclosure of which is incorporated herein by reference.

This application may be related to the copending U.S. patent application Ser. No. 11/281,732, filed Nov. 18, 2005 entitled "Dust Collecting Apparatus for a Vacuum Cleaner" by Jung-Gyun Han et al., the entire disclosure of which is incorporated herein by reference.

This application may be related to the copending U.S. patent application Ser. No. 11/315,335, filed Dec. 23, 2005 entitled "Multi-Cyclone Dust Separating Apparatus" by Dong-Yun Lee et al., the entire disclosure of which is incorporated herein by reference.

This application may be related to the U.S. Pat. No. 7,097,680, granted Aug. 29, 2006 entitled "Cyclone Separating Apparatus and Vacuum Cleaner Equipped with the Same" by Jang-Keun Oh, the entire disclosure of which is incorporated herein by reference.

FIELD OF THE INVENTION

The present invention relates to a vacuum cleaner. More particularly, the present invention relates to a cyclone separating apparatus for a vacuum cleaner.

BACKGROUND OF THE INVENTION

Generally, vacuum cleaners generate a suction force to draw-in dirt from a surface to be cleaned. The vacuum cleaners are provided with a dust collecting apparatus that separates and collects dust, dirt, particulates, debris, contaminants, and other similar matter from the air drawn into the vacuum cleaner. The term "dust" will be used herein to refer collectively to dust, dirt, particulates, debris, contaminants, and other similar matter that can be entrained with the air suctioned by the vacuum cleaner.

Cyclone separating apparatuses are well known as dust collecting apparatuses for a vacuum cleaner. The conventional cyclone separating apparatus can effectively remove relatively large dust from the drawn-in air but often cannot effectively remove fine dust.

To remove fine dust more effectively, a multi-cyclone separating apparatus has been developed. The multi-cyclone separating apparatus has a first cyclone to remove relatively large dust and a plurality of second cyclones to remove fine dust from the air discharged from the first cyclone. An example of the conventional multi-cyclone separating apparatus is presented in Korean Patent Publication No. 10-2005-25711.

However, in the conventional multi-cyclone separating apparatus for a vacuum cleaner, air enters and is discharged through an upper portion of the first cyclone. Because the air whirls downward and then has move upward to exit, the air path prevents high dust separating efficiency. Also, the dust separated from the first cyclone is collected in a space in fluid communication with where the air is whirling. Thus, the collected dust impedes the whirling of the air.

Therefore, there is a need for a vacuum cleaner having a cyclone separating apparatus that can more effectively separate dust from drawn-in air and that can collect dust without affecting the whirling air.

BRIEF SUMMARY OF THE INVENTION

The present invention has been developed in order to overcome the above drawbacks and problems associated with the conventional arrangement. An aspect of the present invention is to provide a cyclone separating apparatus for a vacuum cleaner that can effectively separate dust and does not cause the dust collected therein to affect whirling air.

One embodiment of the present invention provides a cyclone separating apparatus for a vacuum cleaner. The cyclone separating apparatus includes a first cyclone having an inclined part and adapted for separating dust and air; a first dust chamber adapted to be disposed substantially around the first cyclone and to be in fluid communication with the first cyclone; at least one second cyclone for separating dust and air adapted to be disposed above the first cyclone and to be in fluid communication with the first cyclone; and a second dust chamber adapted to be in disposed within the first cyclone and to be in fluid communication with the second cyclone.

Another embodiment of the present invention provides a cyclone separating apparatus for a vacuum cleaner. The cyclone separating apparatus includes a first cyclone unit, a second cyclone unit disposed above the first cyclone unit, and an upper cover adapted to be disposed on the second cyclone unit. The first cyclone unit includes a first cyclone having air entering part disposed at a lower portion of the first cyclone and an air discharging part disposed at an upper portion of the first cyclone, a first dust chamber adapted to wrap around the first cyclone with a space formed therein to collect the dust discharged from the first cyclone, and a second dust chamber adapted to be disposed in the first cyclone. The second cyclone unit includes at least one second cyclone adapted to be disposed above the first cyclone unit, a dust guide member adapted to be disposed at a bottom end of the at least one second cyclone in fluid communication with the second dust chamber, and a housing adapted to substantially enclose the at least one second cyclone.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

Throughout the drawings, like reference numerals will be understood to refer to like parts, components, and structures.

DETAILED DESCRIPTION OF THE INVENTION

Hereinafter, certain exemplary embodiments of the present invention will be described in detail with reference to the accompanying drawings.

The matters defined in the description, such as a detailed construction and elements thereof, are provided to assist in a comprehensive understanding of the invention. Thus, it is apparent that the present invention may be carried out without those defined matters. Also, well-known functions or constructions are omitted to provide a clear and concise description of exemplary embodiments of the present invention.

Figure 1:
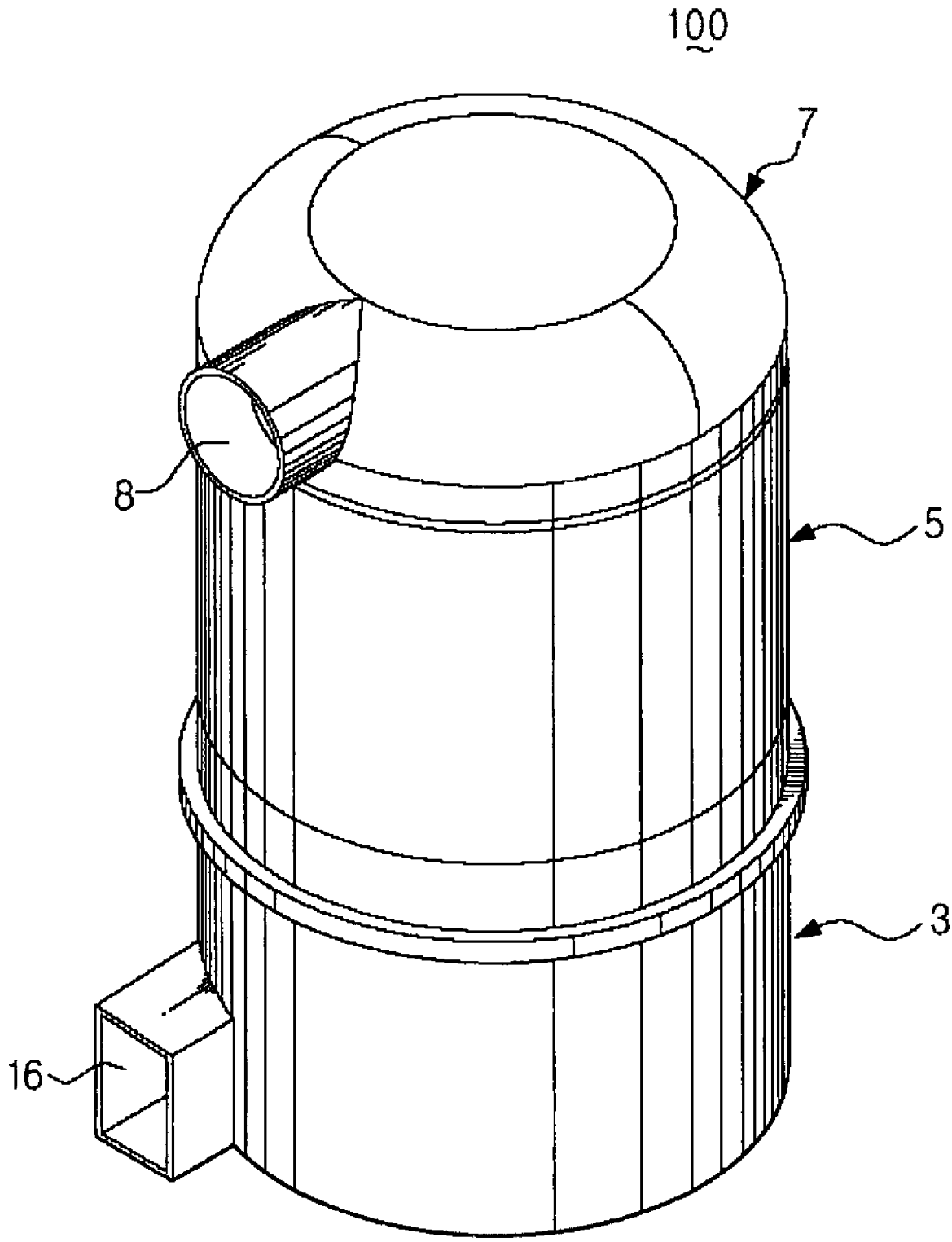
FIG. 1 is a perspective view illustrating a cyclone separating apparatus for a vacuum cleaner according to a first embodiment of the present invention.

Referring to FIG. 1, a perspective view illustrating a cyclone separating apparatus 100 for a vacuum cleaner according to a first embodiment of the present invention is shown. The cyclone separating apparatus 100 for a vacuum cleaner may include a first cyclone unit 3, a second cyclone unit 5, an upper cover 7, a discharging pipe 8, and a first air entering pipe 16. The discharging pipe 8 may be disposed at the upper cover 7 and may be in fluid communication with a vacuum generator (not illustrated) of the vacuum cleaner. The first air entering pipe 16 may be in fluid communication with a suction nozzle (not illustrated) of the vacuum cleaner.

Figure 2:
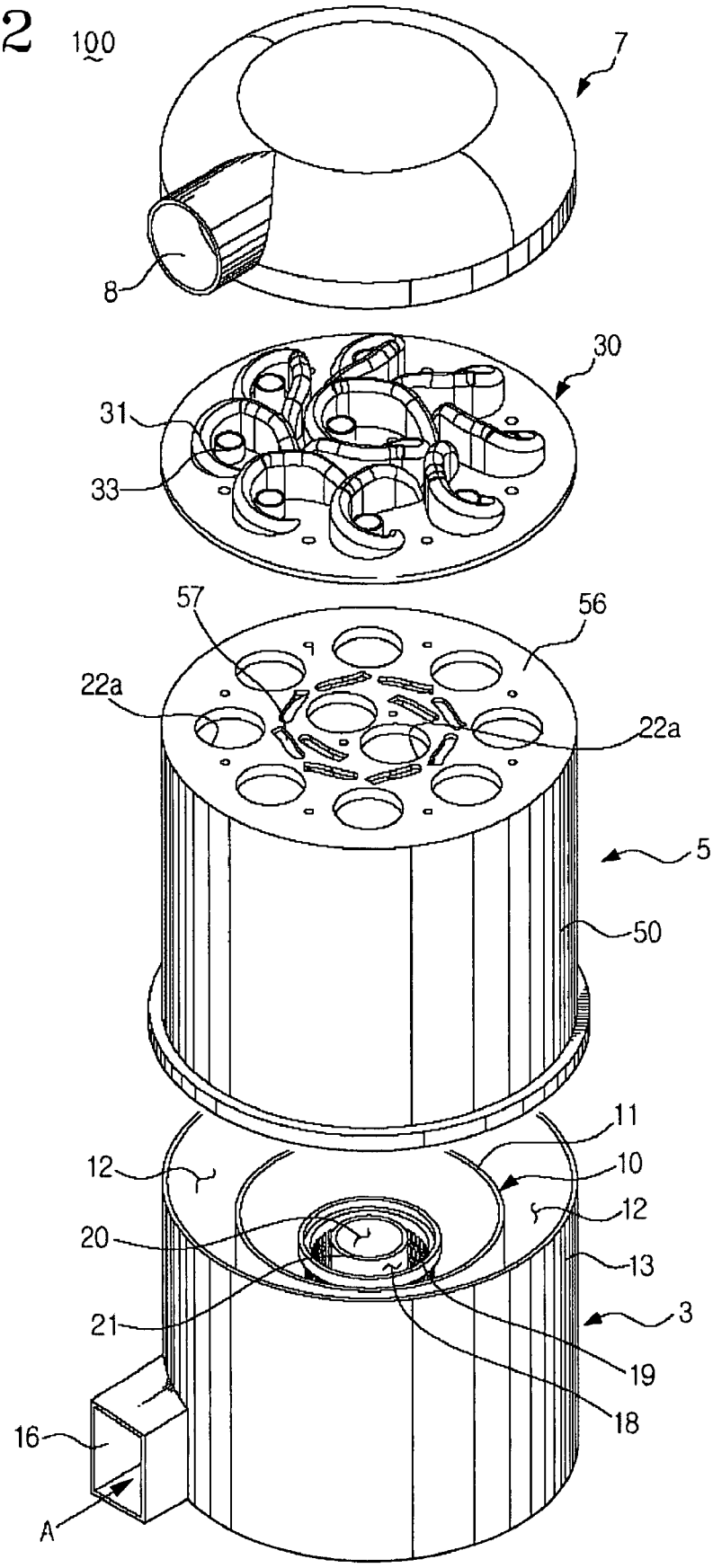
FIG. 2 is an exploded perspective view illustrating the cyclone separating apparatus for a vacuum cleaner of FIG. 1.

Referring to FIG. 2, an exploded perspective view of the cyclone separating apparatus 100 is shown. The upper cover 7 may cover an upper plate 30. The upper plate 30 may cover top ends 22*a* of a plurality of second cyclone chambers 22 (shown in FIG. 3). The upper plate 30 may include a plurality of second air entering parts 31 and a plurality of second air discharging parts 33. The air discharged from the plurality of second air discharging parts 33 may be exhausted outside through the discharging pipe 8.

The second cyclone unit 5 may be disposed above the first cyclone unit 3 and may have a housing 50. The housing 50 may have a plurality of air openings 57 formed at a top surface 56 of the housing 50. The housing 50 may be disposed to enclose the plurality of second cyclone chambers 22 (shown in FIG. 3) and may be formed in a shape corresponding to an outer wall 13 of the first cyclone unit 3. In embodiment shown in FIG. 2, the housing 50 is formed in a substantially cylindrical shape.

The first cyclone unit 3 may include a first cyclone chamber 10, a first dust chamber 12, and a second dust chamber 20. The first cyclone chamber 10 may be provided with an inner wall 11. The inner wall 11 may be disposed substantially around the first cyclone chamber 10 to form a substantially hollow cylindrical shape. A bottom end of the first cyclone chamber 10 may be closed with a base plate 15 (shown in FIG. 3). A top end of the first cyclone chamber 10 may be open. Near the bottom of the first cyclone chamber 10 may be formed the first air entering pipe 16 through which air enters from outside. The first air entering pipe 16 may be received through the outer wall 13 and may project through the first dust chamber 12. The first air entering pipe 16 may be disposed in a substantially tangential direction relative to the inner wall 11.

The first dust chamber 12 may be disposed around the first cyclone chamber 10 and may collect dust discharged from the first cyclone chamber 10. The first dust chamber 12 may be formed within the inner wall 11 of the first cyclone chamber 10 and the outer wall 13. The first dust chamber 12 may have a bottom end closed by the base plate 15 (shown in FIG. 3) and an open top end. Dust discharged from the first cyclone chamber 10 may enter an upper portion of the first dust chamber 12 and may be collected in the first dust chamber 12. As a result, air whirling in the first cyclone chamber 10 is not substantially affected by the collected dust in the first dust chamber 12.

The second dust chamber 20 may be disposed within the first cyclone chamber 10. The second dust chamber 20 may be formed with a dust receptacle 21 which has a substantially hollow cylindrical shape. The second dust chamber 20 may have a bottom end closed by the base plate 15 (shown in FIG. 3) and an open top end. Near an upper portion of the second dust chamber 20 may be formed a first air discharging part 19 through which air of the first cyclone chamber 10 is discharged to the plurality of second cyclone chambers 22 (shown in FIG. 3). The first air discharging part 19 may be disposed to wrap around an upper portion of the dust receptacle 21 but may be spaced apart from the upper portion of the dust receptacle 21. A space between the first air discharging part 19 and the dust receptacle 21 may form a first air flow path through which air discharged from the first cyclone chamber 10 may pass.

Figure 3:
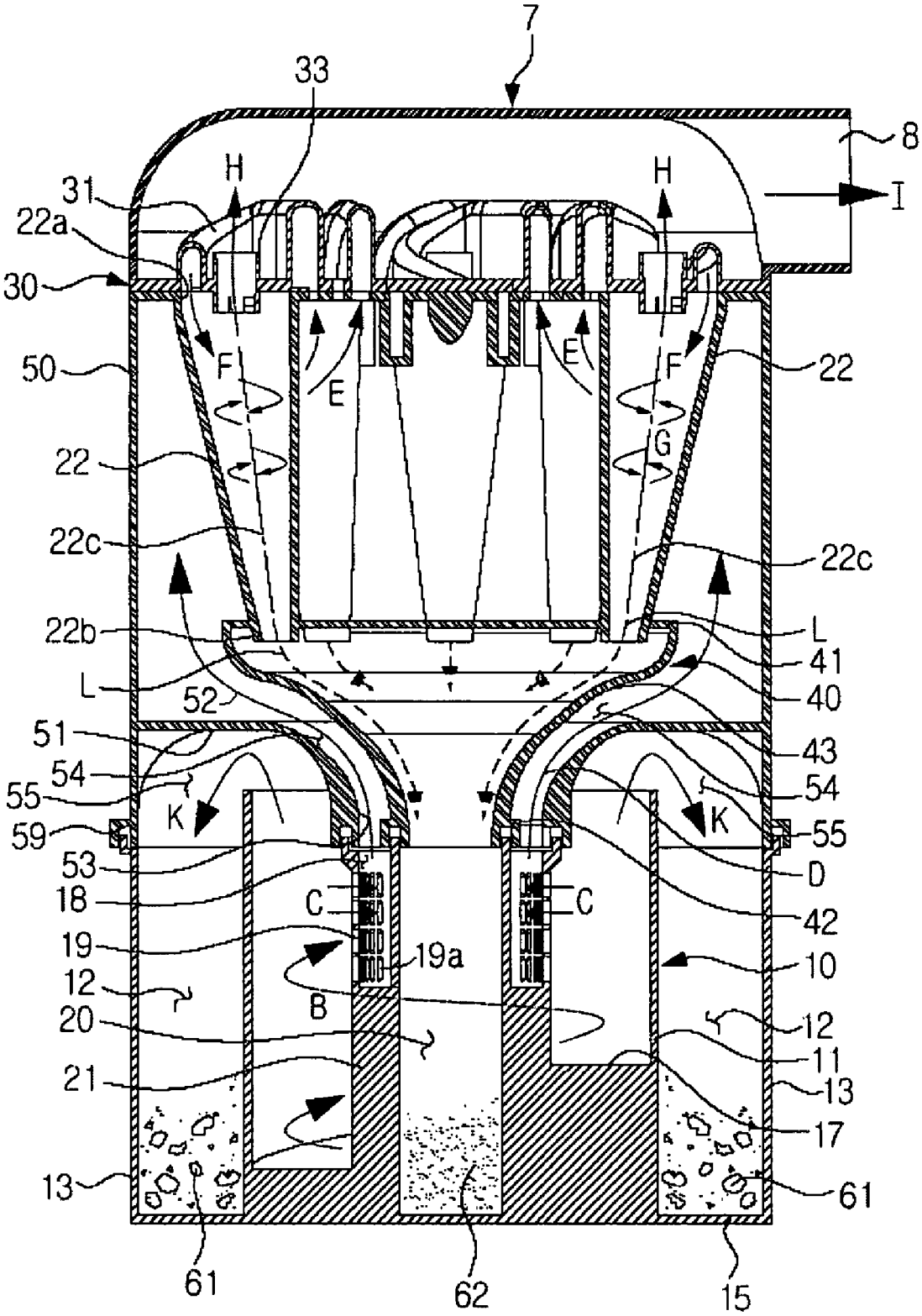
FIG. 3 is a sectional view illustrating the cyclone separating apparatus for a vacuum cleaner of FIG. 1.

Referring to FIG. 3, a sectional view illustrating the cyclone separating apparatus 100 is shown. The first air discharging part 19 may be formed with a plurality of slits 19*a* through which air enters. Alternatively, although not illustrated, the first air discharging part 19 may be formed with a plurality of small circular holes through which air enters.

An inclined part or ramp surface 17 may be disposed at the bottom end of the first cyclone chamber 10 to force air entering through the first air entering pipe 16 to whirl and rise up. Outside air may enter a lower portion of the first cyclone chamber 10 and may whirl upwardly. Thus, air entering the first cyclone chamber 10 would whirl and flow in a direction against gravity. The first cyclone chamber 10 mainly separates relatively large dust from the whirling air by a centrifugal force. The dust may move upward with the whirling air along the inner wall 11 and may then be discharged over the top end of the inner wall 11 as illustrated by arrow K.

A dust guide path 55 may be formed at a bottom surface 51 of the housing 50. The dust guide path 55 may connect the upper portion of the first cyclone chamber 10 and the upper portion of the first dust chamber 12. Therefore, dust discharged from the first cyclone chamber 10 may be collected into the first dust chamber 12 through the dust guide path 55. The dust guide path 55 may have a curved section so that dust can move smoothly from the first cyclone chamber 10 to the first dust chamber 12.

The second cyclone unit 5 may separate fine dust from the air discharged from the first cyclone chamber 10. The second cyclone unit 5 may include a plurality of second cyclone chambers 22 and a dust guide member 40.

The plurality of second cyclone chambers 22 may be disposed above the first cyclone chamber 10. Each of the second cyclone chambers 22 may be formed as a substantially hollow truncated cone with opposite open ends 22*a* and 22*b*. Each of the second cyclone chambers 22 may have a longitudinal center axis 22*c*, which extends vertically downward. Alternatively, each of the second cyclone chambers 22 may be formed as a substantially hollow truncated cone with the longitudinal center axis 22*c* extending down and radially inward so that a side of the second cyclone chambers 22 aligns substantially vertically with the fust cyclone unit 3 as illustrated in FIG. 3.

In the present embodiment, as illustrated in FIG. 3, the plurality of second cyclone chambers 22 may be disposed so that the bottom ends 22*b* of the plurality of second cyclone chambers 22 are a predetermined distance apart from the upper part of the first cyclone chamber 10. The bottom ends 22*b* of the plurality of second cyclone chambers 22 may be disposed to be a predetermined distance apart from a dust guide path 55 that may be formed at the bottom surface 51 of the housing 50. The dust discharged from the top end of the inner wall 11 may pass along the dust guide path 55.

The dust guide member 40 may be disposed below the plurality of second cyclone chambers 22 and may be adapted to provide fluid communication between the bottom ends 22*b* of the plurality of second cyclone chambers 22 and the top end of the second dust chamber 20. The dust guide member 40 may be formed substantially as a hollow inverted cone with a closed top end 41 and an open bottom end 42. The top end 41 may be sized to accept a lower portion of the second cyclone chambers 22. At the top end 41 of the dust guide member 40, a plurality of cyclone holes 41*a* corresponding to the number of second cyclone chambers 22 may be formed. Each of the cyclone holes 41*a* may provide an airtight coupling to a lower portion of the second cyclone chamber 22. The bottom end 42 of the dust guide member 40 may be formed to couple with the top end of the dust receptacle 21 of the second dust chamber 20. Thus, dust discharged from the plurality of second cyclone chambers 22 may be guided by the dust guide member 40 to fall into the second dust chamber 20.

A connection part 53 may be formed at approximately the center of the bottom surface 51 of the housing 50 and may couple with the first air discharging part 19 of the first cyclone unit 3. The dust guide member 40 may be inserted into a center of the connection part 53. The connection part 53 may be formed in a substantially conical shape corresponding to the side surface 43 of the dust guide member 40.

A gap 54 may be formed between the connection part 53 of the housing 50 and a side surface 43 of the dust guide member 40. The gap 54 may provide a second air flow path 52 in fluid communication with the first air flow path 18 formed at the first air discharging part 19. The second air flow path 52 may allow air discharged from the first cyclone chamber 10 to pass through to the inside of housing 50.

Furthermore, at the bottom end of the housing 50 may be formed an insert groove 59 into which the top end of the outer wall 13 of the first cyclone unit 3 can be inserted. The insert groove 59 and the top end of the outer wall 13 may be adapted to provide a separable coupling between the first cyclone unit 3 and the second cyclone unit 5.

The above-described plurality of second cyclone chambers 22, dust guide member 40, and housing 50 may be formed in a single body through an injection molding process.

Figure 4:
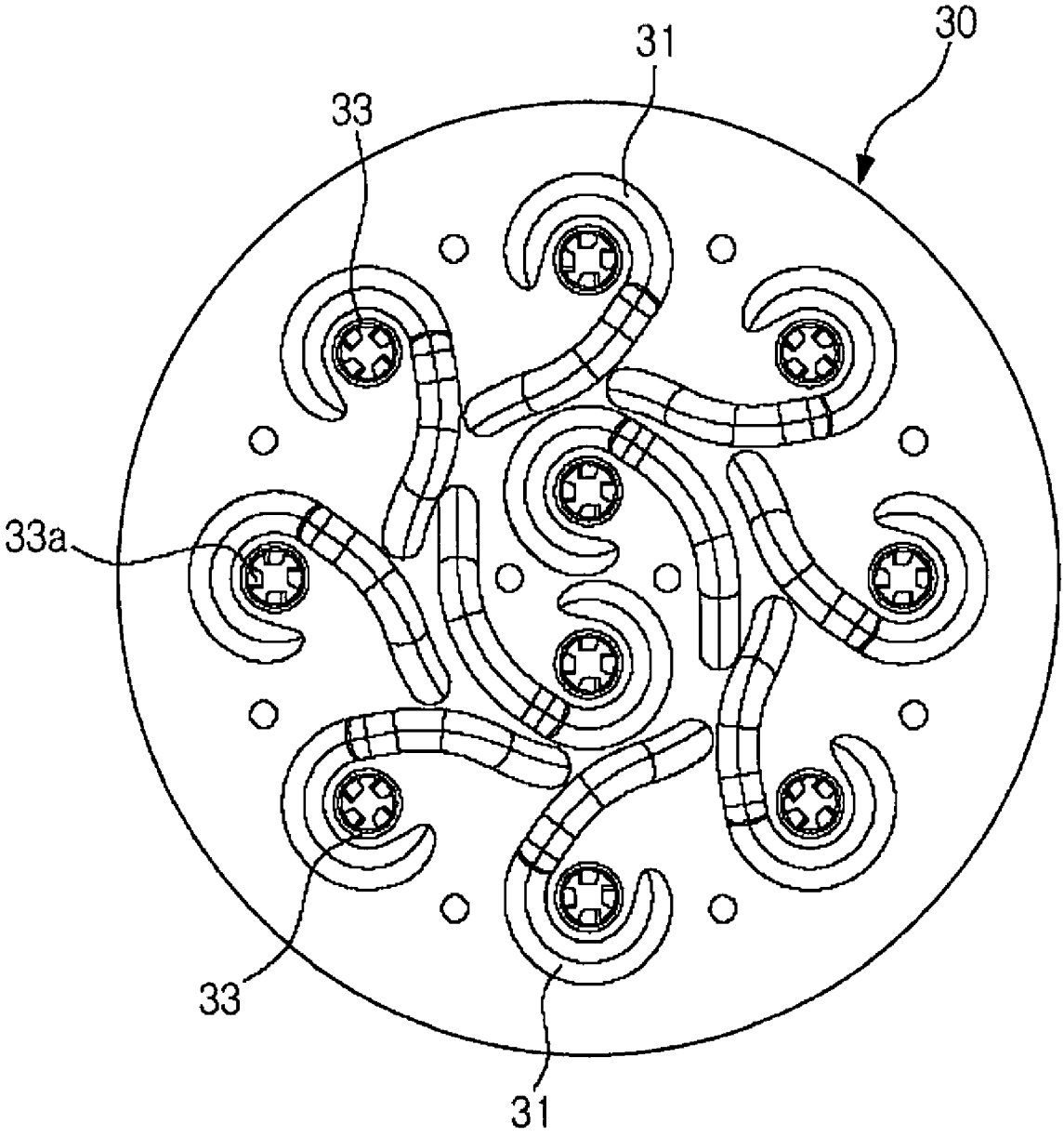
FIG. 4 is a plan view illustrating an upper plate of the cyclone separating apparatus for a vacuum cleaner of FIG. 1.

The upper plate 30 may cover the top ends 22*a* of the plurality of second cyclone chambers 22. Referring to FIG. 4, each of the plurality of second cyclone chamber 22 may include at least one second air entering part 31 and at least one second air discharging part 33. Each of the second air entering parts 31 may be formed in a substantially helical shape.

Figure 5:
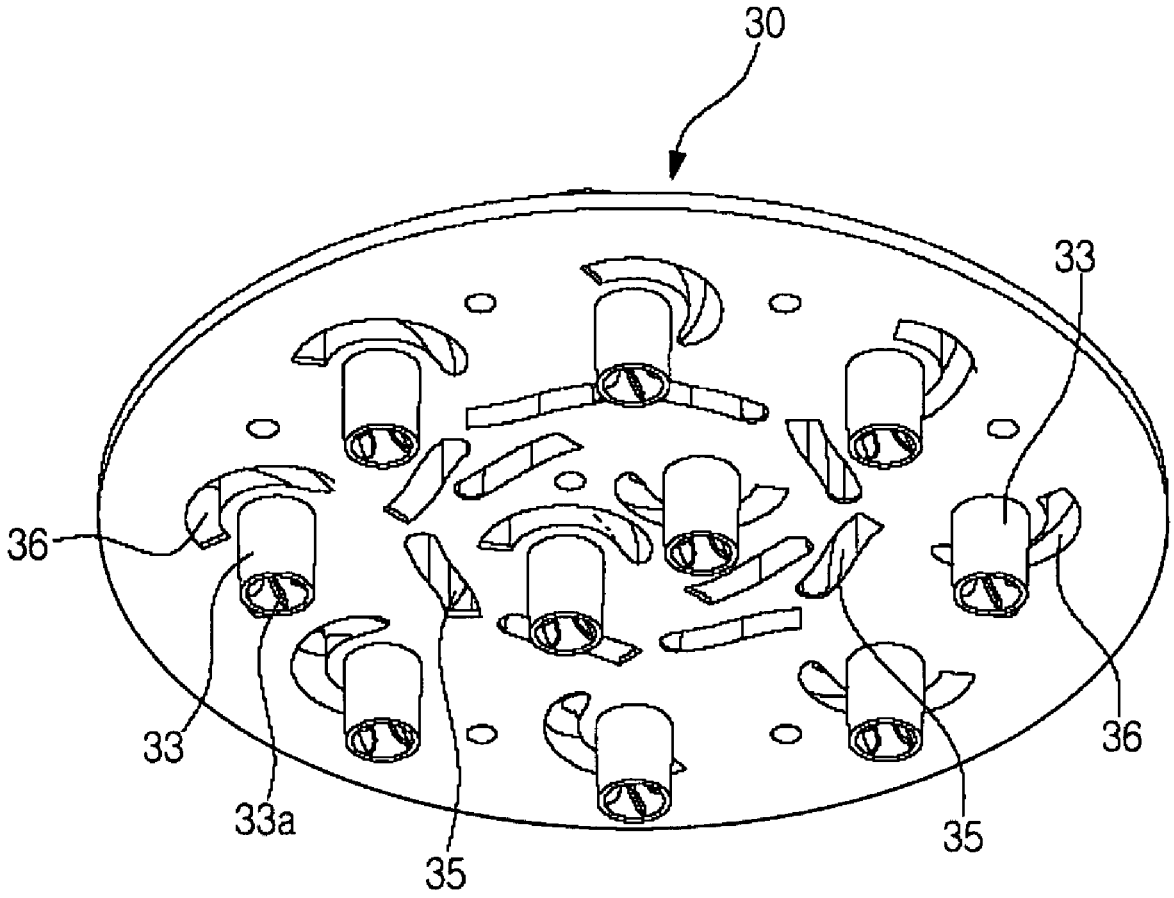
FIG. 5 is a bottom perspective view illustrating the upper plate of the cyclone separating apparatus for a vacuum cleaner of FIG. 1.

Referring to FIG. 5, the second air entering part 31 may include an entrance 35 and an exit 36. The entrance 35 may be connected with the air opening 57 (shown in FIG. 2) which may be formed at the top surface 56 of the housing 50. The exit 36 may be connected with the top end 22*a* of the second cyclone chamber 22. The exit 36 may be formed in a substantially circular shape corresponding to the top end 22*a* of the second cyclone chamber 22, and the entrance 35 may be formed in a substantially long slot shape. Air discharged from the first cyclone chamber 10 may flow through the air opening 57 to the entrance 35 of the air entering part 31. The air may then leave the air entering part 31 through exit 35 and may flow into the top end 22*a* of the second cyclone chamber 22. From the top end 22*a*, the air may flow into an upper portion of the second cyclone chamber 22.

The second air discharging part 33 may be formed in a substantially hollow cylindrical shape. It may be disposed in the upper plate 30 at approximately the center of the top end 22*a* of each second cyclone chamber 22. Air rising up in the second cyclone chamber 22 may be discharged through the second air discharging part 33 to an upper side of the upper plate 30. A plurality of projections 33*a* may be disposed near a bottom end of the second air discharging part 33 to block dust from being discharged with the air.

The plurality of second cyclone chambers 22 may force air discharged from the first cyclone chamber 10 to enter an upper portion of each of the second cyclone chambers 22 and whirl in each second cyclone chamber 22 to separate fine dust. The fine dust may be separated from the air is discharged through the bottom end 22*b* of the second cyclone chamber 22, and the air may be discharged through the upper portion of the second cyclone chamber 22.

In FIGS. 2, 4, and 5, the second cyclone unit 5 is provided with 10 second cyclone chambers 22 so that 8 second cyclone chambers 22 is disposed to form substantially a circle with 2 second cyclone chambers 22 disposed inside the circle formed by the 8 second cyclone chambers 22. The arrangement of the 10 second cyclone chambers 22 as described above is only exemplary and not intended to be limiting. The number of second cyclone chambers 22 may be greater than or less than the ten second cyclone chambers 22 depicted.

Hereinafter, an operation of the cyclone separating apparatus 100 for a vacuum cleaner according to the first embodiment of the present invention with the above-described structure will be explained with reference to FIGS. 1 and 3.

When the vacuum generator (not illustrated) operates, suction draws in dust and air through the first air entering pipe 16 (as indicated by arrow A in FIG. 1) and into the lower portion of the first cyclone chamber 10. The dust and air entering the lower portion of the first cyclone chamber 10 may whirl and rise along the inclined part 17 (as indicated by arrow B in FIG. 3). When the dust and air whirl and rise, a centrifugal force separates the dust from the air. The first cyclone chamber 10 may separate relatively large dust from the air. The separated dust may rise up along the inner wall 11 of the first cyclone chamber 10, may travel through the dust guide member 55, and then may fall into the first dust chamber 12 where it is collected (as indicated by arrow K in FIG. 3).

After the relatively large dust is removed, the air may be discharged through the first air discharging part 19, as indicated by arrow C in FIG. 3. After passing through the first air discharging part 19, the air may flow along the first air flow path 18 between the first air discharging part 19 and the dust receptacle 21. The air may then enter inside the housing 50 through the second air flow path 52 between the dust guide member 40 and the connection part 53, as indicated by arrow D in FIG. 3.

The air inside the housing 50 may flow through the plurality of air openings 57 formed at the top surface 56 of the housing 50 and may enter the entrances 35 of the plurality of second air entering parts 31, as indicated by arrow E in FIG. 3. Because the second air entering part 31 may be formed in a substantially helical shape, the second air entering part 31 may force the air to whirl downwardly as it enters the second cyclone chamber 22. The air may leave each second air entering part 31 through the exit 36 of each second air entering part 31 and may enter the second cyclone chamber 22 through the top end 22*a* of the second cyclone chamber 22 as indicated by arrow F in FIG. 3.

When air is whirling in the second cyclone chamber 22 as indicated by arrow G in FIG. 3, fine dust may be separated from the air by a centrifugal force. The separated dust may move downwardly along the second cyclone chamber 22 and may fall into the dust guide member 40 as indicated by arrow L in FIG. 3. The fine dust may be gathered by the dust guide member 40 and may fall into the second dust chamber 20 where it may be collected.

The air whirling inside each of the second cyclone chambers 22 may be discharged to the upper side of the upper plate 30 through the second air discharging part 33 as indicated by arrow H in FIG. 3. The second air discharging parts 33 may be disposed at the top end 22*a* of each second cyclone 20. The air discharged from the plurality of second cyclone chambers 22 may be gathered inside the upper cover 7 and may be discharged through the discharging pipe 8, as indicated by arrow I in FIG. 3. The air discharged from the discharging pipe 8 may be exhausted outside through the vacuum generator (not illustrated).

Figure 6:
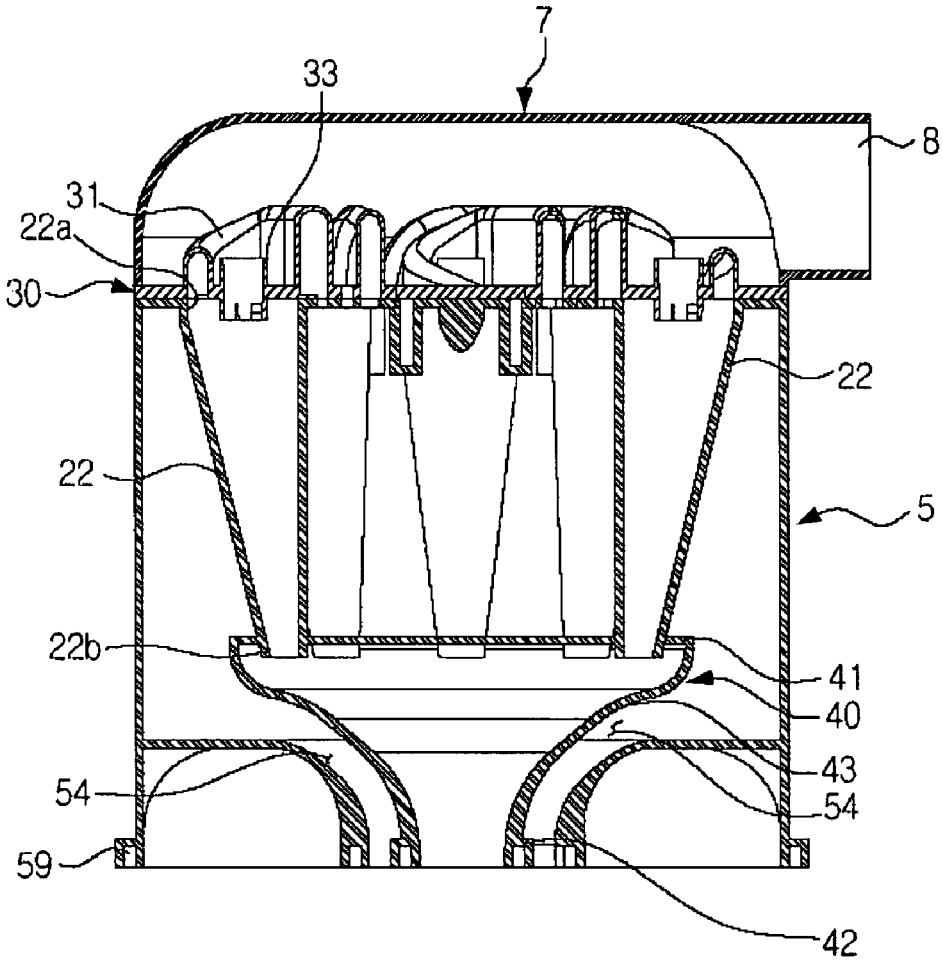
FIG. 6 is a sectional view illustrating a first cyclone unit and a second cyclone unit of the cyclone separating apparatus for a vacuum cleaner of FIG. 1 with the first and second cyclone units exploded from each other.
Figure 6:
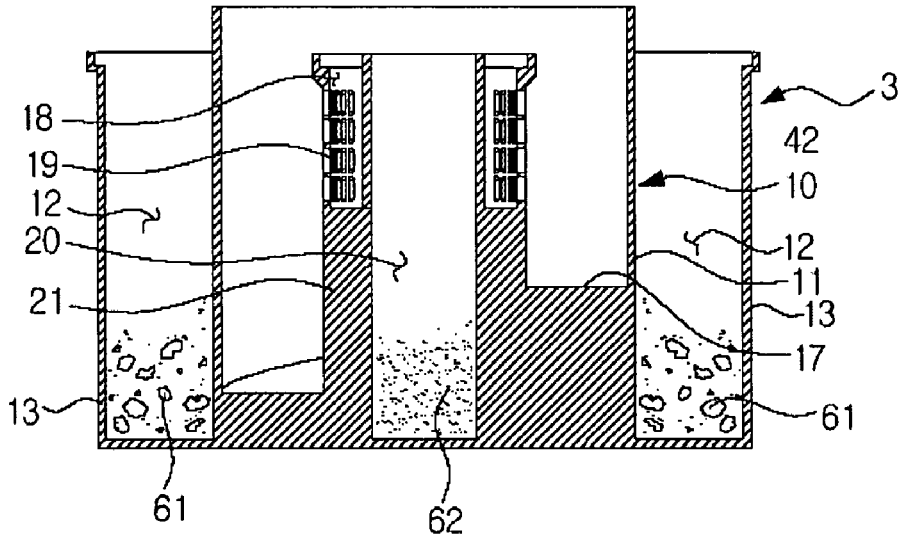

When at least one of the first and second dust chambers 12 and 20 of the first cyclone unit 3 is full, the first and second dust chambers 12 and 20 can be emptied. Referring to FIG. 6, to empty the relatively large dust 61 collected in the first dust chamber 12 and the fine dust 62 collected in the second dust chamber 20, the first cyclone unit 3 may be separated from the second cyclone unit 5. Thereafter, a user may turn the first cyclone unit 3 upside down so that dust 61 and 62 collected in each of the first and second dust chambers 12 and 20 can be easily emptied.

Figure 7:
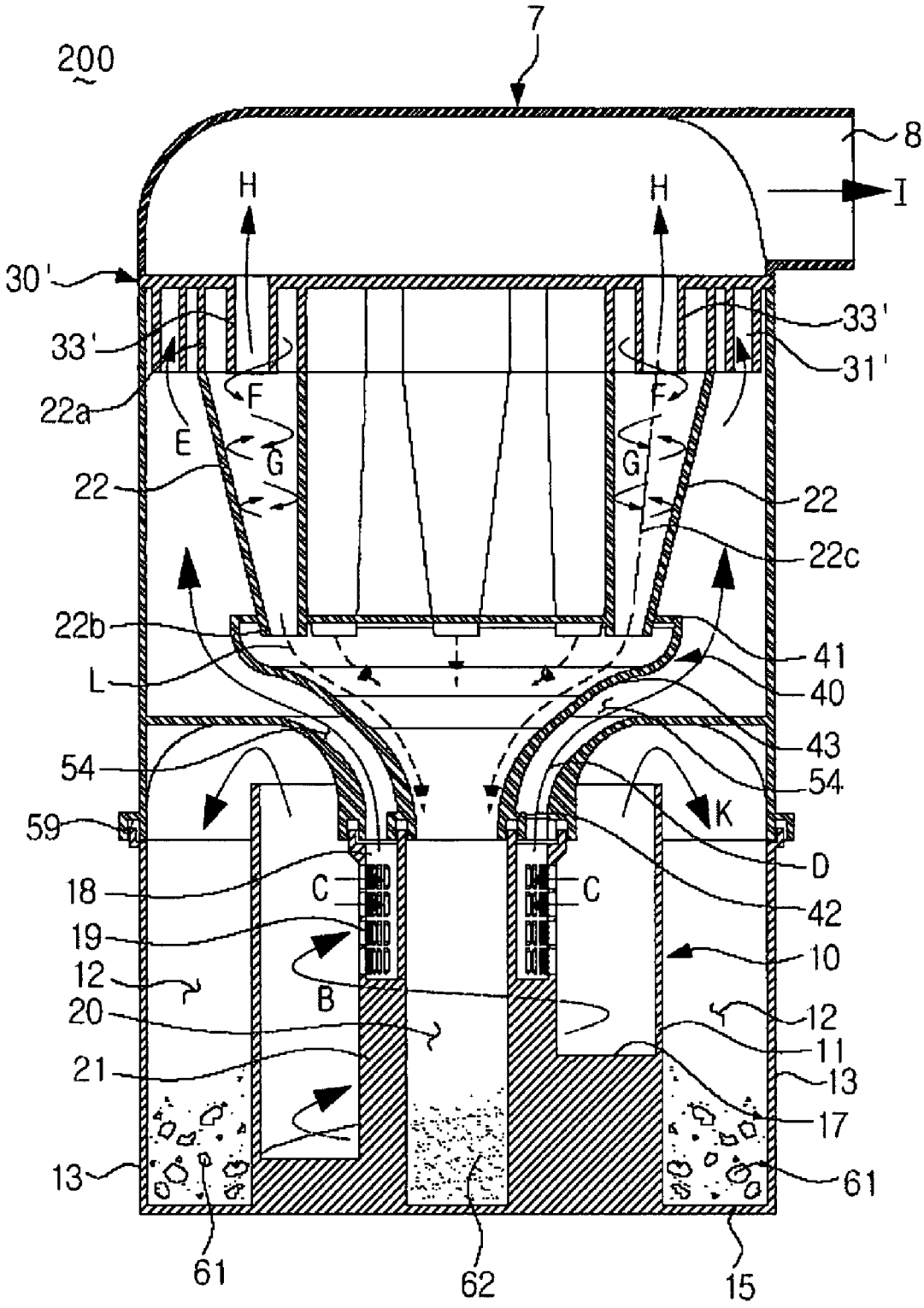
FIG. 7 is a sectional view illustrating a cyclone separating apparatus for a vacuum cleaner according to a second embodiment of the present invention.

Referring to FIG. 7, a sectional view illustrating a cyclone separating apparatus 200 for a vacuum cleaner according to a second embodiment of the present invention is shown. The same reference numerals are used for those elements that are the same as the first embodiment. The cyclone separating apparatus 200 for a vacuum cleaner according to a second embodiment may include a first cyclone unit 3, a second cyclone unit 5, and an upper cover 7. The second cyclone unit 5 may include a plurality of second cyclone chambers 22, a dust guide member 40, and a housing 50.

The plurality of second cyclone chambers 22 may be disposed above the first cyclone chamber 10. Each of the second cyclone chambers 22 may be formed as a substantially hollow truncated cone with opposite open ends. Each of the second cyclone chambers 22 may have a longitudinal center axis 22*c*, which may be inclined downwardly in a vertical direction so that the bottom ends 22*b* of the plurality of second cyclone chambers 22 are close to one another.

Figure 8:
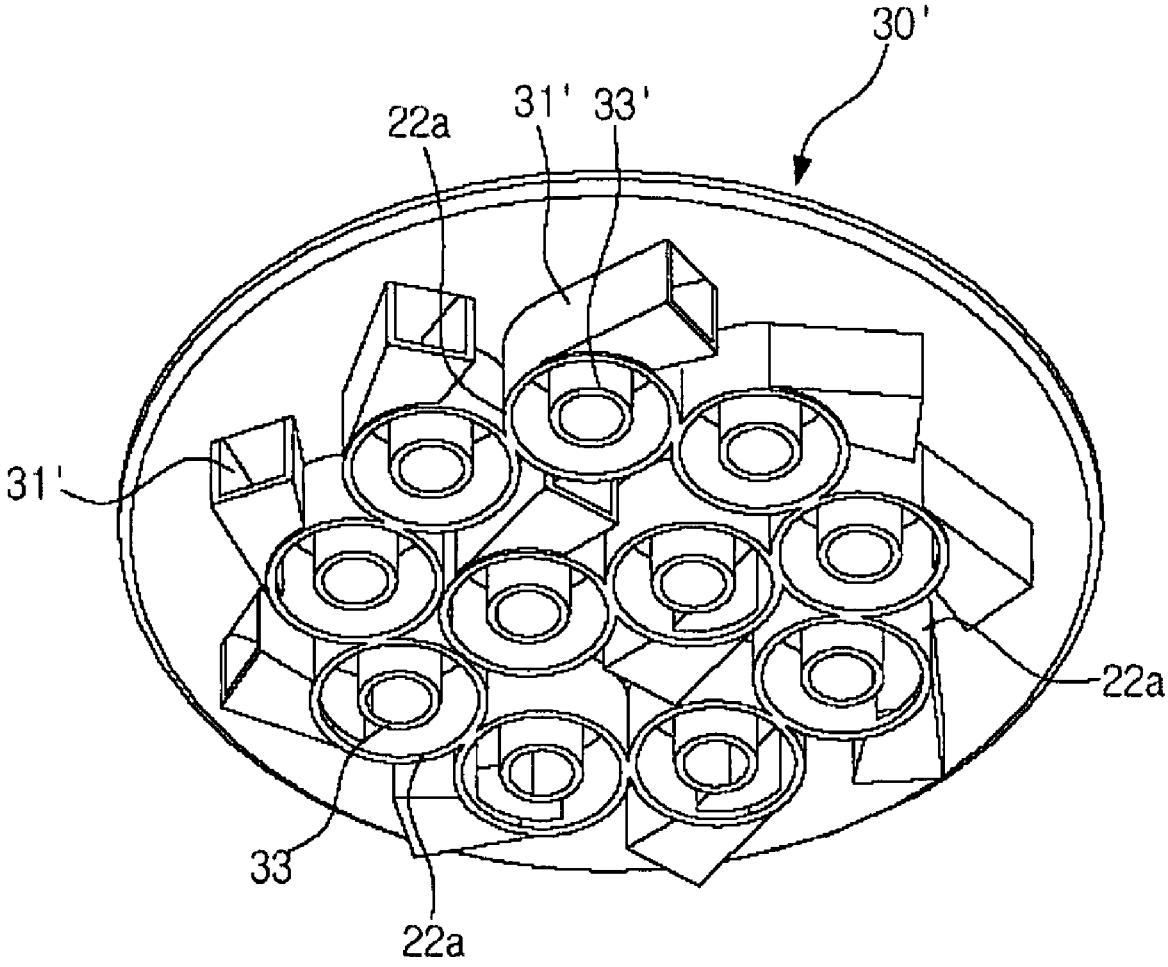
FIG. 8 is a bottom perspective view illustrating an upper plate of the cyclone separating apparatus for a vacuum cleaner of FIG. 7.

An upper plate 30' may cover the top ends of the plurality of second cyclone chambers 22. Referring to FIG. 8, at a bottom surface of the upper plate 30' may be formed a plurality of second air entering parts 31' and a plurality of second air discharging parts 33' corresponding to the plurality of second cyclone chambers 22.

Each of the second air entering parts 31' may be formed in the upper portion 22*a* of the second cyclone chamber 22 in a direction tangential to the second cyclone chamber 22. Therefore, air discharged from the first cyclone chamber 10 may enter the upper portion 22*a* of the second cyclone chamber 22 in the tangential direction through the second air entering part 31'.

The second air discharging part 33' may be formed in a substantially hollow cylindrical shape, and may be disposed approximately in the center of the upper portion 22*a* of the second cyclone chamber 22 in the upper plate 30'. Therefore, air rising up in the second cyclone chamber 22 may be discharged to an upper side of the upper plate 30' through the second air discharging part 33'.

Each of the plurality of second cyclone chambers 22 may force air discharged from the first cyclone chamber 10 to enter an upper portion 22*a* of the second cyclone chamber 22 and whirl inside the second cyclone chamber 22 so that fine dust may be separated from the air. After the dust is separated from the air, the air may be discharged through the upper portion of the second cyclone chamber 22. The dust separated from the air may be discharged through a bottom end 22*b* of the second cyclone 20.

In above description, the upper plate 30' may be formed separately from the housing 50. Alternatively, the housing 50 may have the plurality of second air entering parts 31' and the plurality of air discharging parts 33' integrally formed on a top surface of the housing 50 without the separate upper plate 30'.

The cyclone separating apparatus 200 for a vacuum cleaner according to the second embodiment of the present invention with the above-described structure may be substantially the same as the cyclone separating apparatus 100 of the first embodiment of the present invention, except for the second air entering parts 31' through which air discharged from the first cyclone chamber 10 enters the plurality of second cyclone chambers 22.

Air discharged from the first cyclone chamber 10 may pass inside the housing 50. Then the air may pass the plurality of air entering parts 31' and enter each of the second cyclone chambers 22. The plurality of second air entering parts 31' may be formed at the bottom surface of the upper plate 30' and may be formed in the direction tangential to the upper portion 22*a* of each second cyclone chamber 22. The dust may be separated from the air entering the second cyclone chamber 22 by centrifugal force and then the air may be discharged outside through the second air discharging part 33'.

Figure 9:
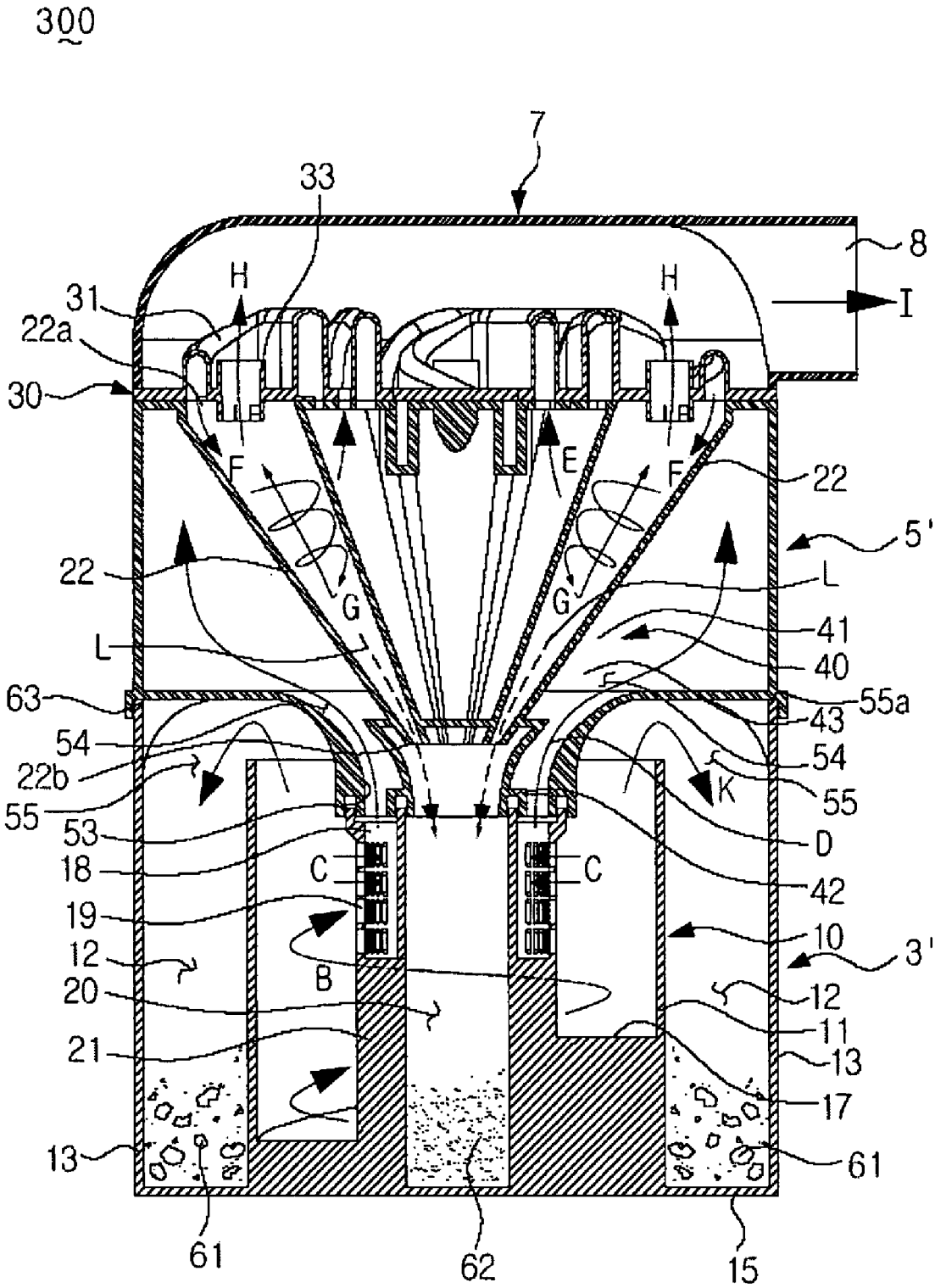
FIG. 9 is a sectional view illustrating a cyclone separating apparatus for a vacuum cleaner according to a third embodiment of the present invention.

Referring to FIG. 9, a sectional view illustrating a cyclone separating apparatus 300 for a vacuum cleaner according to a third embodiment of the present invention is shown. The cyclone separating apparatus 300 for a vacuum cleaner according to a third embodiment may include a plurality of second cyclone chambers 22 partially disposed within the first cyclone chamber 10. The plurality of second cyclone chambers 22 may be disposed so that the bottom ends 22*b* are below a top end 55*a* of the first cyclone unit 3'.

The plurality of second cyclone chambers 22 may be disposed so that a bottom end 22*b* thereof locates below a top end 55*a* of the dust guide path 55 that forms an upper portion of the first cyclone chamber 10. A coupling part 63 of the first and second cyclone units 3' and 5' may be formed at substantially the same level as that of the top end 55*a* of the dust guide path 55. The top end 55*a* of the dust guide path 55 may form the top end of the first cyclone unit 3'.

If a part of the plurality of second cyclone chambers 22, such as the lower parts of the second cyclone chambers 22, is disposed within the first cyclone chamber 10, the height of the second cyclone unit 5' may be reduced. Therefore, it can provide a more compact cyclone separating apparatus than the embodiments described above.

The structure and operation of the cyclone separating apparatus 300 for a vacuum cleaner according to the third embodiment of the present invention may be similar to those of the cyclone separating apparatus 100 of the first embodiment of the present invention, except that the lower part of the plurality of second cyclone chambers 22 is disposed inside the first cyclone chamber 10; and therefore, detail descriptions thereof will be omitted.

The cyclone separating apparatus 300 according to the third embodiment may be used with the cyclone separating apparatus 100 according to the first embodiment. It may be formed so that the lower part of the plurality of second cyclone chambers 22 of the cyclone separating apparatus 100 according to the first embodiment is inserted inside the first cyclone chamber 10. Alternatively, the cyclone separating apparatus 200 according to the second embodiment can be used for the same structure.

With a cyclone separating apparatus for a vacuum cleaner according to an embodiment of the present invention, air may enter a lower portion of a first cyclone unit and then may be discharged through an upper portion thereof so that dust can be separated effectively and collected.

As apparent from the above description, the present invention provides a cyclone separating apparatus for a vacuum cleaner. The dust separated from air in the first cyclone unit may be collected in a space separate from where the air is whirling so that the collected dust does not affect the whirling air.

Furthermore, a cyclone separating apparatus for a vacuum cleaner according to an embodiment of the present invention may have a structure in that a first cyclone unit can be separated from a second cyclone unit to empty dust collected in first and second dust chambers of the first cyclone unit.

Also, with a cyclone separating apparatus for a vacuum cleaner according to an embodiment of the present invention, a plurality of second cyclones can be located above a first cyclone so that the plurality of second cyclones can be arranged freely.

Furthermore, with a cyclone separating apparatus for a vacuum cleaner according to an embodiment of the present invention, a plurality of second cyclones may be disposed so that some part of the plurality of second cyclones is inside a first cyclone. Thus, the height of the cyclone separating apparatus may be reduced. Therefore, the cyclone separating apparatus can be more compact than the conventional cyclone separating apparatus.

While embodiments of the present invention have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the invention.

What is claimed is:

1. A cyclone separating apparatus for a vacuum cleaner comprising:

a first cyclone having an inclined part and adapted for separating dust and air;

a first dust chamber adapted to be disposed substantially around the first cyclone and to be in fluid communication with the first cyclone;

at least one second cyclone for separating dust and air adapted to be disposed above the first cyclone and to be in fluid communication with the first cyclone; and a second dust chamber adapted to be in disposed within the first cyclone and to be in fluid communication with the second cyclone.

2. The cyclone separating apparatus of claim 1, wherein a lower portion of the at least one second cyclone is adapted to be spaced apart from an upper portion of the first cyclone.

3. The cyclone separating apparatus of claim 1, wherein the at least one second cyclone is adapted to be disposed to partly extend into the first cyclone.

4. The cyclone separating apparatus of claim 1 further comprising a housing adapted to substantially enclose the at least one second cyclone and to be in fluid communication with the first cyclone and the at least one second cyclone.

5. The cyclone separating apparatus of claim 1, wherein the at least one second cyclone includes an air entering part formed in a substantially helical shape.

6. The cyclone separating apparatus of claim 1, wherein the at least one second cyclone includes an air entering part formed in a direction tangential to an upper portion of the second cyclone.

7. The cyclone separating apparatus of claim 1 further comprising a dust guide member adapted to be disposed between the at least one second cyclone and the second dust chamber.

8. The cyclone separating apparatus of claim 7, wherein the dust guide member is formed in a substantially conical shape.

9. A cyclone separating apparatus for a vacuum cleaner comprising:

a first cyclone unit including, a first cyclone having an air entering part disposed at a lower portion of the first cyclone and an air discharging part disposed at an upper portion of the first cyclone, a first dust chamber adapted to wrap around the first cyclone with a space formed therein to collect the dust discharged from the first cyclone, and a second dust chamber adapted to be disposed in the first cyclone;

a second cyclone unit disposed above the first cyclone unit, and including, at least one second cyclone adapted to be disposed above the first cyclone unit, a dust guide member adapted to be disposed at a bottom end of the at least one second cyclone in fluid communication with the second dust chamber, and a housing adapted to substantially enclose the at least one second cyclone; and an upper cover adapted to be disposed on the second cyclone unit.

10. The cyclone separating apparatus of claim 9, wherein the second cyclone unit is formed so that the bottom end of the at least one second cyclone is spaced apart from the first cyclone.

11. The cyclone separating apparatus of claim 9, wherein the second cyclone unit is adapted so that some part of the at least one second cyclone locates inside the first cyclone.

12. The cyclone separating apparatus of claim 9, wherein the housing comprises a connection part formed at a bottom surface of the housing to be connected with the air discharging part.

13. The cyclone separating apparatus of claim 9, wherein the housing further comprises a dust guide path adapted to be disposed at a bottom surface of the housing and to provide fluid communication between the first cyclone and the first dust chamber.

14. The cyclone separating apparatus of claim 9, further comprising a second air entering part and a second air discharging part adapted to be disposed at an upper portion of the at least one second cyclone.

15. The cyclone separating apparatus of claim 14, wherein the second air entering part is formed in substantially helical shape.

16. The cyclone separating apparatus of claim 14, wherein the second air entering part is adapted to be disposed in a tangential direction to the upper portion of the at least one second cyclone.

17. The cyclone separating apparatus of claim 14, wherein the second air entering part and the second air discharging part are adapted to be disposed on an upper plate.

18. The cyclone separating apparatus of claim 9, wherein the second cyclone unit is adapted to be detachably coupled to the first cyclone unit.

19. The cyclone separating apparatus of claim 9, wherein the at least one second cyclone is a plurality of second cyclones arranged substantially in a circle.

20. The cyclone separating apparatus of claim 19, wherein the plurality of second cyclones comprise chambers at least one second cyclone disposed within the circle formed the plurality of second cyclones.

* * * * *